US011118256B2

(12) United States Patent
Pinger et al.

(10) Patent No.: US 11,118,256 B2
(45) Date of Patent: Sep. 14, 2021

(54) HOT-DIP GALVANIZATION SYSTEM AND HOT-DIP GALVANIZATION METHOD

(71) Applicant: Fontaine Holdings NV, Houthalen (BE)

(72) Inventors: Thomas Pinger, Haltern am See (DE); Lars Baumgürtel, Nottuln (DE)

(73) Assignee: Fontaine Holdings NV, Houthalen (BE)

( * ) Notice: Subject to any disclaimer, the term of this patent is extended or adjusted under 35 U.S.C. 154(b) by 43 days.

(21) Appl. No.: 16/087,287

(22) PCT Filed: Jan. 9, 2017

(86) PCT No.: PCT/EP2017/050309
§ 371 (c)(1),
(2) Date: Sep. 21, 2018

(87) PCT Pub. No.: WO2017/162342
PCT Pub. Date: Sep. 28, 2017

(65) Prior Publication Data

US 2019/0100830 A1 Apr. 4, 2019

(30) Foreign Application Priority Data

Mar. 21, 2016 (DE) ..... 102016003323.1
Apr. 11, 2016 (DE) ..... 102016106617.6

(51) Int. Cl.

| | |
|---|---|
| ***C23C 2/02*** | (2006.01) |
| ***C23C 2/00*** | (2006.01) |
| ***C23C 2/06*** | (2006.01) |
| ***C23C 2/14*** | (2006.01) |
| ***C23C 2/30*** | (2006.01) |
| ***C23C 2/26*** | (2006.01) |

(52) U.S. Cl.
CPC ..... *C23C 2/003* (2013.01); *C23C 2/02* (2013.01); *C23C 2/06* (2013.01); *C23C 2/14* (2013.01); *C23C 2/26* (2013.01); *C23C 2/30* (2013.01)

(58) Field of Classification Search
None
See application file for complete search history.

(56) References Cited

U.S. PATENT DOCUMENTS 2,520,658 A * 8/1950 Rheem ..... C23C 2/06 427/239
2,764,124 A * 9/1956 Reed ..... C23C 2/006 118/302
2,856,895 A * 10/1958 Anderson ..... C23C 2/003 118/423
3,639,142 A * 2/1972 Maxwell ..... C23C 2/385 427/310
4,113,182 A * 9/1978 Brago ..... B05B 7/32 222/134
4,315,042 A * 2/1982 Spigarelli ..... B23K 1/015 427/99.3
4,448,820 A * 5/1984 Buschor ..... B05B 13/0264 118/663

(Continued)

*Primary Examiner* — Charles Capozzi
(74) *Attorney, Agent, or Firm* — Edward E. Sowers; Brannon Sowers & Cracraft PC

(57) ABSTRACT

The invention relates to a system and a method for hot-dip galvanizing compounds, preferably for mass-production hot-dip galvanizing a plurality of identical or similar components, preferably for batch galvaniztion.

10 Claims, 4 Drawing Sheets

(56) References Cited

U.S. PATENT DOCUMENTS

| | | | | |
|---|---|---|---|---|
| 5,145,531 | A * | 9/1992 | Turner | B23K 1/203 148/23 |
| 5,534,067 | A * | 7/1996 | Fulker | B05B 12/122 118/323 |
| 2019/0048452 | A1* | 2/2019 | Pinger | C23C 2/003 |
| 2019/0078187 | A1* | 3/2019 | Pinger | C23C 2/003 |

* cited by examiner

HOT-DIP GALVANIZATION SYSTEM AND HOT-DIP GALVANIZATION METHOD

CROSS-REFERENCES TO RELATED APPLICATIONS

This application is a National Stage filing of International Application PCT/EP 2017/050309 (WO 2017/162342), entitled HOT-DIP GALVANIZATION SYSTEM AND HOT-DIP GALVANIZATION METHOD, claiming priority to German Application Nos. DE 10 2016 003 323.1 filed Mar. 21, 2016 and DE 10 2016 106 617.6 of filed Apr. 11, 2016. The subject application claims priority to PCT/EP 2017/050309, to DE 10 2016 003 323.1 and to DE 10 2016 106 617.6 and incorporates all by reference herein, in their entirety.

BACKGROUND OF THE INVENTION

The present invention relates to the technical field of the galvanization of iron-based and/or iron-containing components, more particularly steel-based and/or steel-containing components (steel components), preferably for the automobile or automotive industry, by means of hot-dip galvanization.

The present invention relates more particularly to a system and also a method for hot-dip galvanizing of components (i.e., of iron-based and/or iron-containing components, more particularly steel-based and/or steel-containing components (steel components)), more particularly for the large-scale (high-volume) (production-line) hot-dip galvanizing of a multiplicity of identical or similar components (e.g., automotive components).

Metallic components of any kind made from iron-containing material, and more particularly components made of steel, often have applications requiring them to receive efficient protection from corrosion. In particular, components made of steel for motor vehicles (automotive), such as automobiles, trucks, utility vehicles and so on, for example, require efficient protection from corrosion that withstands even long-term exposures.

In this connection it is known practice to protect steel-based components against corrosion by means of galvanizing (zincking). In galvanizing, the steel is provided with a generally thin zinc coat in order to protect the steel from corrosion. There are various galvanizing methods that can be used here to galvanize components made of steel, in other words to coat them with a metallic covering of zinc, including in particular the methods of hot-dip galvanizing, zinc metal spraying (flame spraying with zinc wire), diffusion galvanizing (Sherardizing), electroplate galvanizing (electrolytic galvanizing), nonelectrolytic zincking by means of zinc flake coatings, and also mechanical zincking. There are great differences between the aforesaid zincking and galvanizing methods, particularly with regard to their implementation, but also to the nature and properties of the zinc layers or zinc coatings produced.

Probably the most important method for corrosion protection of steel by means of metallic zinc coatings is that of hot-dip galvanizing. This process sees steel immersed continuously (e.g. coil and wire) or in pieces (e.g., components) in a heated tank containing liquid zinc at temperatures from around 450° C. to 600° C. (melting point of zinc: 419.5° C.), thus forming on the steel surface a resistant alloy layer of iron and zinc and, over that, a very firmly adhering pure zinc layer.

In the context of hot-dip galvanizing, a distinction is made between batchwise, piece galvanizing (cf., e.g. DIN EN ISO 1461) and continuous, coil galvanizing (DIN EN 10143 and DIN EN 10346). Both piece galvanizing and coil galvanizing are normalized or standardized processes. Coil-galvanized steel is a precursor or intermediate (semifinished product) which, after having been galvanized, is processed further by means in particular of forming, punching, trimming, etc., whereas components to be protected by piece galvanizing are first fully manufactured and only thereafter subjected to hot-dip galvanizing (thus providing the components with all-round corrosion protection). Piece galvanizing and coil galvanizing also differ in terms of the thickness of the zinc layer, resulting in different durations of protection. The zinc layer thickness on coil-galvanized sheets is usually not more than 20 to 25 micrometers, whereas the zinc layer thicknesses on piece-galvanized steel parts are customarily in the range from 50 to 200 micrometers and even more.

Hot-dip galvanizing affords both active and passive corrosion protection. The passive protection is through the barrier effect of the zinc coating. The active corrosion protection comes about on the basis of the cathodic activity of the zinc coating. Relative to more noble metals in the electrochemical voltage series, such as iron, for example, zinc serves as a sacrificial anode, protecting the underlying iron from corrosion until the zinc itself is corroded entirely.

The piece galvanizing according to DIN EN ISO 1461 is used for the hot-dip galvanizing of usually relatively large steel components and constructions. It sees steel-based blanks or completed workpieces (components) being pretreated and then immersed into the zinc melt bath. The immersion allows, in particular, even internal faces, welds, and difficult-to-access locations on the components or workpieces for galvanizing to be readily reached.

Conventional hot-dip galvanizing is based in particular on the dipping of iron and/or steel components into a zinc melt to form a zinc coating or zinc covering on the surface of the components. In order to ensure the adhesiveness, the imperviosity, and the unitary nature of the zinc coating, there is generally a requirement beforehand for thorough surface preparation on the components to be galvanized, customarily comprising a degrease with subsequent rinsing operation, a subsequent acidic pickling with downstream rinsing operation, and, finally, a flux treatment (i.e., so-called fluxing), with a subsequent drying operation.

The typical process sequence of conventional piece galvanizing by hot-dip galvanization customarily takes the following form: in the case of piece galvanizing of identical or similar components (e.g. large-scale/high-volume or mass production of automotive components), for reasons of process economy and economics, they are typically collated or grouped for the entire procedure (this being done in particular by means of a common goods carrier (article carrier), configured for example as a crosspiece or rack, or of a common mounting or attachment apparatus for a multiplicity of these identical or similar components). For this purpose, a plurality of components are attached on the goods carrier via holding means, such as latching means, tie wires or the like, for example. The components in the grouped state are subsequently supplied via the goods carrier to the subsequent treatment steps or stages.

First of all, the component surfaces of the grouped components are subjected to degreasing, in order to remove residues of greases and oils, employing degreasing agents in the form, customarily, of aqueous alkaline or acidic degreasing agents. Cleaning in the degreasing bath is followed customarily by a rinsing operation, typically by immersion into a water bath, in order to prevent degreasing agents being entrained with the galvanization material into the next operational step of pickling, this being especially important in particular in the case of a switch from alkaline degreasing to an acidic base.

The next step is that of pickling treatment (pickling), which serves in particular to remove homologous impurities, such as rust and scale, for example, from the steel surface. Pickling is customarily accomplished in dilute hydrochloric acid, with the duration of the pickling procedure being dependent on factors including the contamination status (e.g., degree of rusting) of the galvanization material, and on the acid concentration and temperature of the pickling bath. In order to prevent or minimize entrainments of residual acid and/or residual salt with the galvanization material, the pickling treatment is customarily followed by a rinsing operation (rinse step).

This is followed by what is called fluxing (treatment with flux), in which the previously degreased and pickled steel surface with what is called a flux, typically comprising an aqueous solution of inorganic chlorides, most frequently with a mixture of zinc chloride ($ZnCl_2$) and ammonium chloride ($NH_4Cl$). On the one hand, the task of the flux is to carry out a final intensive fine-purification of the steel surface prior to the reaction of the steel surface with the molten zinc, and to dissolve the oxide skin on the zinc surface, and also to prevent renewed oxidation of the steel surface prior to the galvanizing procedure. On the other hand, the flux raises the wetting capacity between the steel surface and the molten zinc. The flux treatment is customarily followed by a drying operation in order to generate a solid film of flux on the steel surface and to remove adhering water, thus avoiding subsequently unwanted reactions (especially the formation of steam) in the liquid zinc dipping bath.

The components pretreated in the manner indicated above are then subjected to hot-dip galvanizing by being immersed into the liquid zinc melt. In the case of hot-dip galvanizing with pure zinc, the zinc content of the melt according to DIN EN ISO 1461 is at least 98.0 wt %. After the galvanization material has been immersed into the molten zinc, it remains in the zinc melting bath for a sufficient time period, in particular until the galvanization material has assumed its temperature and has been coated with a zinc layer. The surface of the zinc melt is typically cleaned to remove, in particular, oxides, zinc ash, flux residues and the like, before the galvanization materials is then extracted from the zinc melt again. The component hot-dip galvanized in this way is then subjected to a cooling process (e.g., in the air or in a water bath). Lastly, the holding means for the component, such as latching means, tie wires or the like, for example, are removed. Subsequent to the galvanizing operation, there is customarily a reworking or after-treatment operation, which in some cases is involved. This operation sees excess zinc residues, particularly what are called droplet runs of the zinc solidifying on the edges, and also oxide or ash residues adhering to the component, being removed as far as possible.

One criterion of the quality of hot-dip galvanization is the thickness of the zinc coating in μm (micrometers). The standard DIN EN ISO 1461 specifies the minimum values of the requisite coating thicknesses to be afforded, depending on thickness of material, in piece galvanizing. In actual practice, the coat thicknesses are well above the minimum coat thicknesses specified in DIN EN ISO 1461. Generally speaking, zinc coatings produced by piece galvanizing have a thickness in the range from 50 to 200 micrometers or even more.

In the galvanizing process, as a consequence of mutual diffusion between the liquid zinc and the steel surface, a coating of iron/zinc alloy layers with differing compositions is formed on the steel part. On withdrawal of the hot-dip galvanized articles, a layer of zinc—also referred to as pure zinc layer—remains adhering to the uppermost alloy layer, this layer of zinc having a composition corresponding to that of the zinc melt. On account of the high temperatures associated with the hot-dipping, a relatively brittle layer is thus formed initially on the steel surface, this layer being based on an alloy (mixed crystals) between iron and zinc, with the pure zinc layer only being formed atop that layer. While the relatively brittle iron/zinc alloy layer does improve the strength of adhesion to the base material, it also hinders the formability of the galvanized steel. Greater amounts of silicon in the steel, of the kind used in particular for the so-called calming of the steel during its production, result in increased reactivity between the zinc melt and the base material and, consequently, in strong growth of the iron/zinc alloy layer. In this way, relatively high overall layer thicknesses are formed. While this does enable a very long period of corrosion protection, it nevertheless also raises the risk, in line with increasing thickness of the zinc layer, that the layer will flake off under mechanical exposure, particularly sudden, local exposures, thereby destroying the corrosion protection effect.

In order to counteract the above-outlined problem of the incidence of the rapidly growing, brittle and thick iron/zinc alloy layer, and also to enable relatively low layer thicknesses in conjunction with high corrosion protection in the case of galvanizing, it is known practice from the prior art additionally to add aluminum to the zinc melt or to the liquid zinc bath. By adding 5 wt % of aluminum to a liquid zinc melt, for example, a zinc/aluminum alloy is produced that has a melting temperature lower than that of pure zinc. By using a zinc/aluminum melt (Zn/Al melt) or a liquid zinc/aluminum bath (Zn/Al bath), on the one hand it is possible to realize much lower layer thicknesses for reliable corrosion protection (generally of below 50 micrometers); on the other hand, the brittle iron/tin alloy layer is not formed, because the aluminum—without being tied to any particular theory—initially forms, so to speak, a barrier layer on the steel surface of the component in question, with the actual zinc layer then being deposited on this barrier layer. Components hot-dip galvanized with a zinc/aluminum melt are therefore readily formable, but nevertheless—in spite of the significantly lower layer thickness by comparison with conventional hot-dip galvanizing with a quasi-aluminum-free zinc melt—exhibit improved corrosion protection qualities. Relative to pure zinc, a zinc/aluminum alloy used in the hot-dip galvanizing bath exhibits enhanced fluidity qualities. Moreover, zinc coatings produced by hot-dip galvanizing carried out using such zinc/aluminum alloys have a greater corrosion resistance (from two to six times better than that of pure zinc), enhanced shapability, and improved coatability relative to zinc coatings formed from pure zinc. This technology, moreover, can also be used to produce lead-free zinc coatings.

A hot-dip galvanizing method of this kind using a zinc/aluminum melt or using a zinc/aluminum hot-dip galvanizing bath is known, for example, from WO 2002/042512 A1 and the relevant equivalent publications to this patent family (e.g., EP 1 352 100 B1, DE 601 24 767 T2 and US 2003/0219543 A1). Also disclosed therein are suitable fluxes for the hot-dip galvanizing by means of zinc/aluminum melt baths, since flux compositions for zinc/aluminum hot-dip galvanizing baths are different to those for conventional hot-dip galvanizing with pure zinc. With the method disclosed therein it is possible to generate corrosion protection coatings having very low layer thicknesses (generally well below 50 micrometers and typically in the range from 2 to 20 micrometers) and having very low weight in conjunction with high cost-effectiveness, and accordingly the method described therein is employed commercially under the designation of microZlNQ® process.

In the piece hot-dip galvanizing of components in zinc/aluminum melt baths, particularly in the case of large-scale (high-volume) piece hot-dip galvanizing of a multiplicity of identical or similar components (e.g. large-scale (high-volume) piece hot-dip galvanizing of automotive components or in the automobile industry), because of the more difficult wettability of the steel with the zinc/aluminum melt and also the low thickness of the zinc coverings or zinc coatings, there is a problem with always subjecting the identical or similar components to identical operating conditions and operating sequences in an economic process sequence, particularly with implementing high-precision hot-dip galvanizing reliably and reproducibly in a manner which affords identical dimensional integrities for all identical or similar components. In the prior art—as well as by costly and inconvenient pretreatment, especially with selection of specific fluxes—this is typically accomplished in particular by special process control during the galvanizing procedure, such as, for example, extended immersion times of the components into the zinc/aluminum melt, since only in this way is it ensured that there are no defects in the relatively thin zinc coatings, or no uncoated or incompletely coated regions.

In order to make the processing sequence economical for the known piece hot-dip galvanizing of identical or similar components, more particularly in the case of large-scale (high-volume) piece hot-dip galvanizing, and to ensure an identical process sequence, the prior art collates or groups a multiplicity of the identical or similar components for galvanizing on a common goods carrier or the like, for example, and guides them in the grouped state through the individual process stages.

The known piece hot-dip galvanizing, however, has various disadvantages. If the articles on the carrier are hung in two or more layers, and especially if the immersion movement of the goods carrier is the same as the emersion movement, the components, or regions of components, inevitably do not spend the same time in the zinc melt. This results in different reaction times between the material of the components and of the zinc melt, and, consequently, in different zinc layer thicknesses on the components. Furthermore, in the case of components with high temperature sensitivity, particularly in the case of high-strength and ultra high-strength steels, such as for spring steels, chassis and bodywork components, and press-hardened forming parts, differences in residence times in the zinc melt affect the mechanical characteristics of the steel. With a view to ensuring defined characteristics on the part of the components, it is vital that defined operating parameters are observed for each individual component.

Furthermore, on withdrawal of the components from the zinc melt, it is inevitable that the zinc will run and will drip from edges and angles of the components. This produces zinc runs on the component. Eliminating these zinc runs subsequently, which is normally a manual task, represents a considerable cost factor, particularly if the piece numbers being galvanized are high and/or if the tolerance requirements to be observed are exacting. With a fully laden goods carrier, it is generally not possible to reach all of the components and there individually remove the zinc runs directly at the site of galvanizing. Customarily, after galvanizing, the galvanized components have to be taken off from the goods carrier, and must be manually examined and worked on individually, in a very costly and inconvenient operation.

In the case of the known piece hot-dip galvanizing, moreover, the immersion and emersion movement of the goods carrier into and out of the galvanizing bath takes place at the same location. The inevitable occurrence of zinc ash, as a reaction product of the flux and the zinc melt, after the immersion of the components, this ash accumulating on the surface of the zinc bath, makes it absolutely necessary, before emersion, for the zinc ash to be removed from the surface by drawing off or washing away, in order to prevent it adhering to the galvanized components on withdrawal, to create as little contamination as possible on the galvanized component. In view of the large number of components in the zinc bath and in view of the comparatively poor accessibility of the surface of the galvanizing bath, removing the zinc ash from the bath surface proves generally to be a very costly and inconvenient, and in some cases problematical, operation. Firstly, in the removal of the zinc ash from the surface of the galvanizing bath, there is a delay to the operation, with a reduction in productivity at the same time, and secondly there is a source of defects in relation to the quality of galvanization of the individual components.

Ultimately, with the known piece hot-dip galvanizing, contaminants and zinc runs remain on the galvanized components and must be removed by manual afterwork. This afterwork is generally very costly and time-consuming. In this regard it should be noted that afterwork here refers not only to the cleaning or remediation, but also, in particular, to the visible inspection. For process-related reasons, all of the components are subject to a risk of contaminants adhering or zinc runs being present, and requiring removal. Accordingly, all of the components must be looked at individually. This inspection alone, without any subsequent steps of work that may be necessary, represents a very high cost factor, particularly in the large-scale (high-volume) production sector with a very large number of components to be inspected and with very high quality requirements.

BRIEF SUMMARY OF THE INVENTION

The problem addressed by the present invention is therefore that of providing a system and a method for piece galvanizing iron-based or iron-containing components, more particularly steel-based or steel-containing components (steel components), by means of hot-dip galvanizing in a zinc/aluminum melt (i.e., in a liquid zinc/aluminum bath), preferably for the large-scale (high-volume) hot-dip galvanizing of a multiplicity of identical or similar components (e.g., automotive components), in which the disadvantages outlined above for the prior art are to be at least largely avoided or else at least diminished.

The intention in particular is to provide a system and a method which, relative to conventional hot-dip galvanizing systems and methods, enable improved operational economics and a more efficient, and especially more flexible, operating sequence.

In order to solve the problem outlined above the present invention—according to a first aspect of the present invention—proposes a system for hot-dip galvanizing; further embodiments, especially particular and/or advantageous embodiments, of the system of the invention are also provided.

The present invention further relates—according to a second aspect of the present invention—to a method for hot-dip galvanizing; further embodiments, especially particular and/or advantageous embodiments, of the method of the invention are also provided.

With regard to the observations hereinafter, it is taken as read that embodiments, forms of implementation, advantages and the like which are set out below in relation to only one aspect of the invention, in order to avoid repetition, shall of course also apply accordingly in relation to the other aspects of the invention, without any special mention of this being needed.

DETAILED DESCRIPTION OF THE INVENTION

Figure 1:
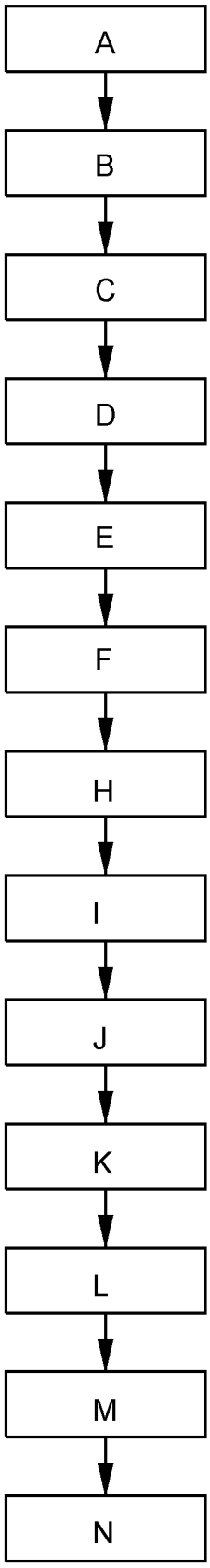
FIG. 1 shows a schematic sequence of the individual stages of the method of the invention.

For all relative and/or percentage weight-based data stated hereinafter, especially relative quantity or weight data, it should further be noted that within the scope of the present invention they are to be selected by the skilled person in such a way that in total, including all components and/or ingredients, especially as defined hereinbelow, they always add up to or total 100% or 100 wt %; this, however, is self-evident to the skilled person.

In any case, the skilled person is able—based on application or consequent on an individual case—to depart, when necessary, from the range data recited hereinbelow, without departing the scope of the present invention.

It is the case, moreover, that all value and/or parameter data stated below, or the like, can in principle be ascertained or determined using standardized or normalized or explicitly specified methods of determination or otherwise by methods of measurement or determination that are familiar per se to the person skilled in this field.

This having been established, the present invention will now be elucidated below in detail.

The invention relates to a system for the hot-dip galvanizing of components, preferably for the large-scale (high-volume) hot-dip galvanizing of a multiplicity of identical or similar components, preferably for piece galvanizing, having a conveying device (conveying means, conveying device (means)) with at least one goods carrier for conveying the components, a flux application device (flux application means, flux application device (means)) for applying a flux to the surface of the components, and a hot-dip galvanizing device (hot-dip galvanizing means, hot-dip galvanizing device (means)) for hot-dip galvanizing the components, having a galvanizing bath containing a zinc/aluminum alloy in liquid melt form.

In accordance with the invention, in a system of the aforesaid kind, the object of the invention is achieved in that the goods carrier is configured for receiving and for transporting at least one separated (isolated) and singled out component and in that the flux application device (means) comprises a spraying device (means) for the preferably automated spray application of the flux to the surface of the separated (isolated) and singled out component.

In accordance with the method, the invention concerns a method for hot-dip galvanizing components using a zinc/aluminum alloy in liquid melt form, preferably for large-scale (high-volume) hot-dip galvanizing a multiplicity of identical or similar components, preferably for piece galvanizing.

In accordance with the invention, in the aforesaid method, each component in the separated (isolated) and singled out state is transported on an goods carrier to a flux application device (means) for the application of flux, where the component in the separated (isolated) and singled out state is provided with the flux by a preferably automated spray application of a spraying device (means), and then the component provided with the flux on its surface is subjected to hot-dip galvanizing in a galvanizing bath containing the zinc/aluminum alloy in liquid melt form.

In connection with the development of the present invention, it was recognized that the spray application of the flux to the components for galvanizing has a considerable influence on the overall galvanizing operation, despite the fact that the spray application of the flux appears at the first glance, particularly in the context of a large-scale (high-volume) production process, to be uneconomic by comparison with fluxing in an immersive flux bath. In connection with the invention, however, it was found that applying the flux by immersing the component into a bath of flux brings with it a series of disadvantages. In immersive fluxing, as it is known, ultimately, when the components are withdrawn from the dipping bath, a nonuniform layer of the flux is produced on the components for galvanizing. While the component in the upper region has a relatively low flux layer thickness, there is an increased layer thickness of the flux in the lower region. Furthermore, residues of flux accumulate to an increased extent in corners and on edges of the components for galvanizing.

In the galvanizing operation which comes subsequent to fluxing, the flux reacts with the zinc melt Because of the differences in flux layer thickness on the component for galvanizing, there may also be a different thickness of the zinc layer on the component. The different zinc layer thickness on the component therefore represents, among other things, the result of the nonuniform layer thickness of the flux.

It is the case, moreover, that with a dipping bath, there are inevitably losses of energy and of radiation, since the dipping bath must generally be maintained at a constant temperature in the range between 60° and 80°. If the temperature falls below a certain level, reheating is required. Not only is this costly, but the continual heating burdens the flux solution. Owing to the ongoing temperature treatment, indeed, it may be the case that various chemicals in the flux are decomposed. Given that a dipping bath is an open bath, moreover, there may be a loss of solvent (water). This inevitably alters the flux composition. Consequently, particularly in the case of dipping baths which are heated over a long time period, there is a risk that the flux will not be applied with the desired and originally formulated composition to the component for galvanizing.

By virtue of the spray application according to the invention, the aforesaid disadvantages are avoided. First of all, spray application is more favorable from an energy standpoint, since it is not necessary to maintain a bath at a relatively high temperature. With the bath absent, energy losses and radiation losses are avoided. Furthermore, the concentration of the flux can be kept permanently constant, since in contrast to an open bath there is no loss of solvent. In the absence of a bath with unavoidable inhomogeneities, the spray application is already more uniform. Furthermore, through a specified concentration control of the flux and through precise control of the thickness of the application, it is possible to control precisely the quality and the layer thickness of the flux. In the spray application context, a defined amount of the flux can be applied in a targeted way. As a result of the spray application it is possible, moreover, to prevent accumulations of flux at corners, edges, folds or the like. All of this ultimately enables homogeneous galvanizing with consistent layer thickness in the galvanizing bath.

It has been determined, moreover, that because of the defined amount of spraying medium applied, spray application results in improved draining of the applied flux. Through precisely metered application of the flux in the case of spray application, it is possible to prevent a concentrated flux solution remaining suspended at the aforesaid corners and edges, or at any rate to reduce such phenomena. Ultimately, as a result of the reduced application, and more particularly uniform application, of the flux, by comparison with immersive or dip coating, no superfluous flux is entrained into the galvanizing bath.

A further key advantage of spray application in accordance with the invention relative to immersive or dip coating is that different fluxes for different scenarios can be employed with greater simplicity. The spraying technology raises the individual adaptability and ensures improved flexibility.

In order to be able to ensure complete spray application of the component for galvanizing, the accessibility of the component from all sides is necessary in the context of automation of the method. For this reason, in one case, the relevant component in the separated (isolated) and singled out state is attached as a single component on the goods carrier and guided through the spraying device (means). In the case of complete separation of the component, in which case there is only one single component attached on the goods carrier, every region of the component is accessible and can be sprayed accordingly.

An alternative possibility, depending on the size and configuration of the goods carrier, is for a small group of components, in other words up to a maximum of 10 components, preferably up to 5 components, to be fastened on said carrier, with these components being disposed in particular in a series one alongside another or one after another, more specifically such that they do not make contact with one another. The distance between the components in the small group that are attached on the carrier ought preferably be at least 10 cm, preferably at least 50 cm, and more particularly more than 1 m from one another. With such a disposition and/or spacing of the individual components of the small group on the goods carrier, the component is separated (isolated) and singled out in the sense of the present invention, since with a spacing of this kind for the components separated (isolated) and singled out from one another, access to every region of the components is ensured for the automated spray application.

In one preferred embodiment of the invention, there is a control device (means) coupled to the spraying device (means) for the automated spray application of the flux. The control device (means), via which it is possible to set, in particular, the spraying times and/or spraying quantity and/or spraying duration and/or spraying direction per unit area of the component, produces a homogeneous spray application and/or a spray application adapted individually to the component, and, consequently, a defined layer thickness of the flux on the component for galvanizing. In this connection it is appropriate for the control device (means) to be configured in such a way that the automated spray application takes place as a function of the form and/or the type and/or the material and/or the surface nature, more particularly the surface roughness, of the component Hence different materials and/or different surface natures may result, for example, in different layer thicknesses, concentrations or else compositions of the flux. In particular, the spray application is automated via the control device (means) in such a way that the concentration of the flux and/or the spraying duration of the spray application per component and/or the spraying duration of the spray application of different regions of the component and/or the thickness of the spray application on the component, more particularly different thicknesses of the spray application on a component, and/or a simultaneous spray application of different fluxes and/or of different flux components, can be set/adjusted.

In order to be able to apply the flux by spraying as exactly as possible to the surface of the separated (isolated) and singled out component, the spraying device (means) comprises a plurality of spraying heads with which it is possible to spray preferably different regions of the component. It is an advantage in this context in particular if at least one spraying head can be moved in X-direction and/or in Y-direction and/or in Z-direction relative to the component. In control terms, the moving of the relevant spraying head, which can be moved preferably in all three directions, is accomplished via the control device (means). Through the aforesaid measure it is ultimately possible, when spraying the flux onto a component, to change the distance and/or the direction of a spraying head of the spraying device (means) relative to the component. In this way it is possible in particular to ensure that regions of the component not directly accessible can nevertheless be reached by appropriate orientation of the spraying head and can be provided with the exact flux layer thickness intended for that region.

The spraying device (means), moreover, is preferably configured for the simultaneous sprayed application of different fluxes and/or different flux components. In constructional terms, in one preferred embodiment in this context, at least one spraying head comprises at least two spraying lines for different fluxes and/or different flux components. In accordance with the method, this means that during a spraying procedure it is possible for different fluxes and/or different flux components to be applied to the relevant component during the spraying procedure, either simultaneously or else with a time stagger. The advantage of this embodiment is that different regions of a component can be sprayed with a different fluxes and/or different flux components. As a result, the subsequent hot-dip galvanizing can be influenced accordingly. In principle, however, it is also possible for directly successive components in the galvanizing procedure to be sprayed with different fluxes/flux components without interrupting the production process.

The spraying device (means) of the flux application device (means) is preferably followed by a drying device (means). This drying device (means) is configured in particular for drying the spray-applied flux in the separated (isolated) and singled out state of the component. Since through the spray application a precisely defined quantity of flux has been applied to the component, the drying step can be carried out relatively quickly and therefore relatively cost-effectively, something which is not possible in comparison to drying after a dipping bath.

In the case of the apparatus of the invention and also in the case of the method of the invention, flux application is preceded preferably by a surface treating and more particularly by degreasing. In accordance with the system, there is preferably a surface treating device (means), more particularly pickling device (means), positioned ahead of the flux application device (means), for the chemical, more particularly wet-chemical, surface treating of the components, by means of a surface treating agent, preferably for the pickling of the surfaces of the components by means of a pickling agent. In particular it is appropriate here for the surface treating device (means) to comprise a spraying device (means) for spray application of the surface treating agent, more particularly of the pickling agent, to the surface of the separated (isolated) and singled out component. In connection with the spray application of the surface treating agent, in principle, the advantages obtaining here are the same as those identified above for the spray application of the flux. In particular, during sprayed application of the surface treating agent, it is possible to ensure that certain regions of the component are sprayed more thickly and/or for longer than other regions. In order to be able to spray the component with the surface treating agent correspondingly at all regions, the separation of the component is also appropriate particularly during surface treatment as well.

It is understood, moreover, that in constructional terms the spraying device (means) for spraying the surface treating agent may be configured, correspondingly, in the same way as the spraying device (means) for spray application of the flux. Here as well it is possible for adjustable spraying heads to be provided, and to use different spraying lines for different surface treating agents and/or different surface treating agent components.

In accordance with the system, moreover, it is an advantage if a degreasing device (means) for degreasing the components by means of a degreasing agent is positioned ahead of the surface treating device (means). With preference the degreasing as well is accomplished by sprayed application of the degreasing agent to the surface of the separated (isolated) and singled out component. In this regard, the advantages stated for the sprayed application of the surface treating agent are valid in the same way. Furthermore, the spraying device (means) for the degreasing agent is configured in constructional terms preferably in exactly the same way as the spraying device (means) for the surface treating agent, and so reference may be made thereto expressly. More particularly, one or more adjustable spraying heads is/are provided, and it is possible for different degreasing agents or degreasing agent components to be spray-applied via at least two separate spraying lines per spraying head.

In order to prevent a treating agent being entrained into the next stage of the method, in accordance with the system, one preferred embodiment of the system of the invention has at least one rinsing device (means) for rinsing the components with a rinsing agent. More particularly, a rinsing device (means) is provided subsequent to the degreasing device (means) and/or subsequent to the surface treating device (means). Preferably there is one rinsing device (means) each subsequent to the degreasing device (means) and subsequent to the surface treating device (means).

In connection with the rinsing, provision may be made for this likewise to be accomplished by spraying with the relevant rinsing agent. Alternatively or else in addition thereto, it is also possible for immersive rinsing to be provided. In all cases, however, it is particularly preferred for the rinsing procedures to be carried out in the separated (isolated) and singled out state of the component, since in that case there is accessibility to all regions of the component.

In one preferred embodiment of the invention, a housing, more particularly a housing closed on all sides, is assigned to the spraying device (means), preferably to each spraying device (means), in connection with the system of the invention. Here it is understood that one or more supply and removal openings for the goods carrier and for the component or components separated (isolated) and singled out thereon can be provided in the housing. By virtue of the housing, ultimately, pollution of the environment with vapors and/or chemicals which are used or which arise during spraying, respectively, is prevented. Furthermore, a housing makes it possible to capture the respective spraying agent, more particularly by means of corresponding floor drains in the housing, and to recycle it for renewed use. As and when necessary, a corresponding processing procedure for the respective spraying agent is provided.

In one preferred embodiment of the invention, additionally to the separated (isolated) and singled out fluxing, provision is made for individual galvanizing of the components, in other words of one component separated (isolated) and singled out on the goods carrier. For this purpose, the invention provides two alternatives. In a first alternative, there is a separating device (means) for the preferably automated supplying, immersing, and emersing of a component separated from the goods carrier into and from the galvanizing bath of the hot-dip galvanizing device (means). In the case of the alternative embodiment to this, the conveying device (means) and the hot-dip galvanizing device (means) are configured such that the separated (isolated) and singled out component on the goods carrier is guided in the separated (isolated) and singled out state through the galvanizing bath.

In connection with the invention it has been recognized that particularly in the case of certain components, such as high-strength and ultra high-strength steels, which are temperature-sensitive, there is a need for targeted and optimized handling of the components during the actual galvanizing operation. In the case of individual galvanizing in connection with the system of the invention and/or the method of the invention, it is readily possible to ensure that the components are each subject to identical operating parameters. For sprung steels or for chassis and bodywork components made from high-strength and ultra high-strength steels particularly, such as press-hardened forming parts, for example, this plays a considerable part. Through the separation of the components for galvanizing it is possible for the reaction times between the steel and the zinc melt to be the same in each case. The ultimate result of this is a constant zinc layer thickness. Moreover, as a result of the galvanization, the characteristic values of the components are influenced identically, since the invention ensures that the components have each been exposed to identical operating parameters.

A further, considerable advantage of the invention, especially in connection with the separating device (means), comes about from the fact that with the separation according to the invention, each component can be manipulated and treated precisely, by means, for example, of specific rotational and steering movements of the component during withdrawal from the melt. As a result, the afterworking cost and complexity can be reduced significantly or even in some cases avoided entirely. The invention affords the possibility, moreover, that zinc ash accumulations can be significantly reduced and in some cases even avoided. This is possible because the process according to the invention can be controlled in such a way that a component for galvanizing, in the separated (isolated) and singled out state, after having been immersed, is moved away from the immersion site and moved toward a site remote from the immersion site. This is followed by emersion. While the zinc ash rises in the region of the immersion site, and is located on the surface of the immersion site, there are few residues of zinc ash, or none, at the emersion site. As a result of this specific technique, zinc ash accumulations can be considerably reduced or even avoided.

In connection with the present invention it has been determined, moreover, that, taking account of the afterwork sometimes no longer necessary in the case of the invention, the overall production time associated with the manufacture of galvanized components can in fact be reduced relative to the prior art, and hence that the invention, ultimately, affords a higher productivity, more particularly because the manual afterworking in the prior art is very time-consuming.

A further system-based advantage associated with separated (isolated) and singled out galvanizing is that the galvanizing vessel required need not be broad and deep, but instead only narrow. This reduces the surface area of the galvanizing bath, which in that way can be shielded more effectively, allowing a critical reduction in the radiation losses.

All in all, by means of the invention with the separated (isolated) and singled out galvanizing, resulting components have higher quality and cleanliness on the surface; the components as such have each been subjected to identical operating conditions and therefore possess the same characteristic component values. From an economic standpoint as well, the invention affords economic advantages over the prior art, since the production time can be reduced by up to 20%, taking account of the afterworking which is no longer necessary or in some cases is greatly limited.

In accordance with the apparatus, for the alternative with the separating device (means), provision is made for the separating device (means) to have at least one separating means disposed between the flux application device (means) and the hot-dip galvanizing device (means). In that case this separating means is preferably configured such that it takes either a separated (isolated) and singled out component from the goods carrier or else takes therefrom a plurality of components in the form of a small group, but located in the state separated (isolated) and singled out from one another, in other words with sufficient distance from one another, and subsequently supplies the separated (isolated) and singled out component or else the small group containing mutually separated (isolated) and singled out components to the hot-dip galvanizing device (means) for hot-dip galvanizing. The separating means here may take off or withdrawn the component directly from the goods carrier, or else may take the component from the group of components already deposited by the goods carrier. Here it is understood that in principle it is also possible for there to be more than one separating means, in other words that a plurality of separated (isolated) and singled out components are hot-dip galvanized simultaneously in the separated (isolated) and singled out state. In this connection, then, it is also understood that at least the galvanizing operation on the separated (isolated) and singled out components is carried out identically, even if components from different separating means are guided simultaneously or with a time stagger and independently of one another through the hot-dip galvanizing device (means) or the galvanizing bath.

In the case of a further, preferred embodiment of the invention, the separating means is configured such that a separated (isolated) and singled out component is immersed into an immersion region of the bath, then moved from the immersion region to an adjacent emersion region, and is subsequently emersed in the emersion region. The aforesaid movement may, moreover, be achieved even when not using a separating means, with the component instead being attached in the separated (isolated) and singled out state on the goods carrier and being supplied via the goods carrier to the galvanizing bath, and immersed into the immersion region, moved to the emersion region, and emersed there. As already observed above, zinc ash occurs at the surface of the immersion region, as a reaction product of the flux with the zinc melt By moving the component immersed into the zinc melt from the immersion region toward the emersion region, there is little or no zinc ash at the surface of the emersion region. In this way, the surface of the emersed galvanized component remains free or at least substantially free from zinc ash accumulations. Here it is understood that the immersion region is adjacent to the emersion region, in other words relating to regions of the galvanizing bath that are spatially separate from one another and in particular do not overlap.

In the case of one preferred embodiment of the aforesaid concept of the invention, moreover, provision is made for the component after immersion to remain in the immersion region of the galvanizing bath at least until the reaction time between the component surface and the zinc/aluminum alloy of the galvanizing bath is at an end. This ensures that the zinc ash, which moves upward within the melt, spreads out only on the surface of the immersion region. The component can be moved subsequently into the emersion region, which is substantially free from zinc ash, and can be emersed there.

In trials conducted in connection with the invention, it was found that it is useful if the component spends between 20% to 80%, preferably at least 50%. of the galvanizing duration in the region of the immersion region, and only thereafter is moved into the emersion region. From a technical system standpoint, this means that the separating device (means) and/or the one or more associated separating means or the conveying device (means) are, by corresponding control, designed and, as and when necessary, harmonized with one another in such a way that the aforesaid method sequence can be carried out without problems.

Particularly in the case of components made from temperature-sensitive steels, and in the case of custom-specific requirements for components with maximally identical product properties, provision is made, in accordance with the system and the method, for the conveying device (means) or the separating means to be configured such that all components are guided in an identical way, more particularly with identical movement, in identical arrangement and/or with identical time, through the galvanizing bath. Ultimately this can easily be achieved by corresponding control of the conveying device (means) and/or of the at least one assigned separating means. As a result of the identical handling, identical components, in other words components consisting in each case of the same material and having in each case the same shape, have product properties that are identical in each case. These properties include not only the same zinc layer thicknesses but also identical characteristic values of the galvanized components, since the latter have each been guided identically through the galvanizing bath.

A further advantage afforded by the invention as a result of the separation during hot-dip galvanizing, in accordance with the system and the method, is that zinc runs can more easily be avoided. Provided for this purpose, in accordance with the system, is a stripping device (means) subsequent to the emersion region, and in the case of one preferred embodiment of this concept of the invention, the conveying device (means) or the separating means is configured such that after emersion, all components are guided past the stripping device (means) for the stripping of liquid zinc in an identical way. In the case of an alternative embodiment in connection with the separating means, but one which can also be realized in combination with the stripping device (means), provision is made for all components to be moved identically after emersion in such a way that droplet runs of liquid zinc are removed, more particularly drip off and/or are spread uniformly over the component surfaces. Through the invention, consequently, it is therefore possible for each individual component to be guided in a defined way not only through the galvanizing bath but also to be guided either in a defined positioning, as for example an inclined attitude of the component, and moved past one or more strippers, and/or for the component to be moved, through specific rotational and/or steering movements after emersion, in such a way that zinc runs are at least substantially avoided.

In the case of one preferred development of the invention, the hot-dip galvanizing device (means) is followed by a cooling device (means), more particularly a quenching device (means), at which the component after the hot-dip galvanizing is cooled or quenched, respectively.

Furthermore, in particular subsequent to the cooling device (means), there may be an after-treating device (means) provided. The after-treating device (means) is used in particular for passivation, sealing or coloring of the galvanized components. Alternatively, the after-treating stage may encompass for example afterworking, more particularly the removal of impurities and/or the removal of zinc runs. As observed above, however, the afterworking step in the case of the invention is reduced considerably relative to the method known in the prior art, and in some cases, indeed, is superfluous.

It is of particular advantage if the control device (means) is coupled not only to the individual spraying facilities but also to the conveying device (means). By such an arrangement it is then possible to change the transport speed of the individual goods carriers as and when required. Thus, for example, it is possible to change the transport speed of one goods carrier, at least regionally, relative to the transport speed of another goods carrier. It is thereby possible for certain method steps which take up more time than others to be adapted to the particular requirements as and when they arise. By this means, the overall sequence of the method of the invention is optimized and therefore shortened.

In the case of one particularly preferred embodiment of the invention, the conveying device (means) comprises a circulating, closed transport section having a plurality of goods carriers, this section leading at least along the surface treating device (means), the flux application device (means), and the hot-dip galvanizing device (means). In particular, the transport section extends along all of the method stages of the system of the invention. This ultimately enables continuous piece galvanizing of the components in the separated (isolated) and singled out state of the components.

The conveying device (means) may in principle be implemented as a crane system. In this case, the separated (isolated) and singled out components are then transported in suspension. In principle, however, it is also possible for the conveying device (means) to be configured as a floor conveying device (means). In that case, the goods carriers run on the floor. In this case, the transport section can be configured as a rail guide. In this context it is also possible, in principle, to provide a combination of a crane system with supplementary floor conveying means.

Furthermore, the invention relates to a system and/or a method of the aforesaid kind, wherein the components are iron-based and/or iron-containing components, more particularly steel-based and/or steel-based components, referred to as steel components, preferably automotive components or components for the automobile sector. Alternatively or additionally, the galvanizing bath comprises zinc and aluminum in a zinc/aluminum weight ratio in the range of 55-99.999:0.001-45, preferably 55-99.97:0.03-45, more particularly 60-98:2-40, preferably 70-96:4-30. Alternatively or additionally, the galvanizing bath has the composition below, wherein the weight figures are based on the galvanizing bath and all of the constituents of the composition in total result in 100 wt %:

(i) zinc, more particularly in amounts in the range from 55 to 99.999 wt %, preferably 60 to 98 wt %,
(ii) aluminum, more particularly in amounts upward of 0.001 wt %, preferably of 0.005 wt %, more preferably in the range from 0.03 to 45 wt %, more preferably between 0.1 to 45 wt %, preferably between 2 to 40 wt %, where the zinc content is then in each case adapted accordingly,
(iii) optionally silicon, more particularly in amounts in the range from 0.0001 to 5 wt %, preferably 0.001 to 2 wt %,
(iv) optionally at least one further ingredient and/or optionally at least one impurity, more particularly from the group of the alkali metals such as sodium and/or potassium, alkaline earth metals such as calcium and/or magnesium and/or heavy metals such as cadmium, lead, antimony, bismuth, more particularly in total amounts in the range from 0.0001 to 10 wt %, preferably 0.001 to 5 wt %.

In connection with trials conducted it was found that in the case of zinc baths having the composition indicated above, it is possible to achieve very thin and very homogeneous coatings on the component, these coatings satisfying in particular the exacting requirements with regard to component quality in automotive engineering.

Alternatively or additionally, the flux has the following composition, where the weight figures are based on the flux and all of the constituents of the composition result in total in 100 wt %:

(i) zinc chloride ($ZnCl_2$), more particularly in amounts in the range from 50 to 95 wt %, preferably 58 to 80 wt %;
(ii) ammonium chloride ($NH_4Cl$), more particularly in amounts in the range from 5 to 50 wt %, preferably 7 to 42 wt %;
(iii) optionally at least one alkali metal salt and/or alkaline earth metal salt, preferably sodium chloride and/or potassium chloride, more particularly in total amounts in the range from 1 to 30 wt %, preferably 2 to 20 wt %;
(iv) optionally at least one metal chloride, preferably heavy metal chloride, more preferably selected from the group of nickel chloride ($NiCl_2$), manganese chloride ($MnCl_2$), lead chloride ($PbCl_2$), cobalt chloride ($CoCl_2$), tin chloride ($SnCl_2$), antimony chloride ($SbCl_3$) and/or bismuth chloride ($BiCl_3$), more particularly in total amounts in the range from 0.0001 to 20 wt %, preferably 0.001 to 10 wt %;

(v) optionally at least one further additive, preferably wetting agent and/or surfactant, more particularly in amounts in the range from 0.001 to 10 wt %, preferably 0.01 to 5 wt %.

Alternatively or additionally, the flux application device (means), more particularly the flux bath of the flux application device (means), comprises the flux in preferably aqueous solution, more particularly in amounts and/or in concentrations of the flux in the range from 200 to 700 g/l, more particularly 350 to 550 g/l, preferably 500 to 550 g/l, and/or the flux is used as a preferably aqueous solution, more particularly with amounts and/or concentrations of the flux in the range from 200 to 700 g/l, more particularly 350 to 550 g/l, preferably 500 to 550 g/l.

In trials with a flux in the aforesaid composition and/or concentration especially in conjunction with the above-described zinc/aluminum alloy, it was found that very low layer thicknesses, in particular of less than 20 μm, are obtained, this being associated with a low weight and reduced costs. Especially in the automotive sector, these are essential criteria.

Further features, advantages, and possible applications of the present invention are apparent from the description hereinafter of exemplary embodiments on the basis of the drawing, and from the drawing itself. Here, all features described and/or depicted, on their own or in any desired combination, constitute the subject matter of the present invention, irrespective of their subsumption in the claims or their dependency reference.

Figure 2:
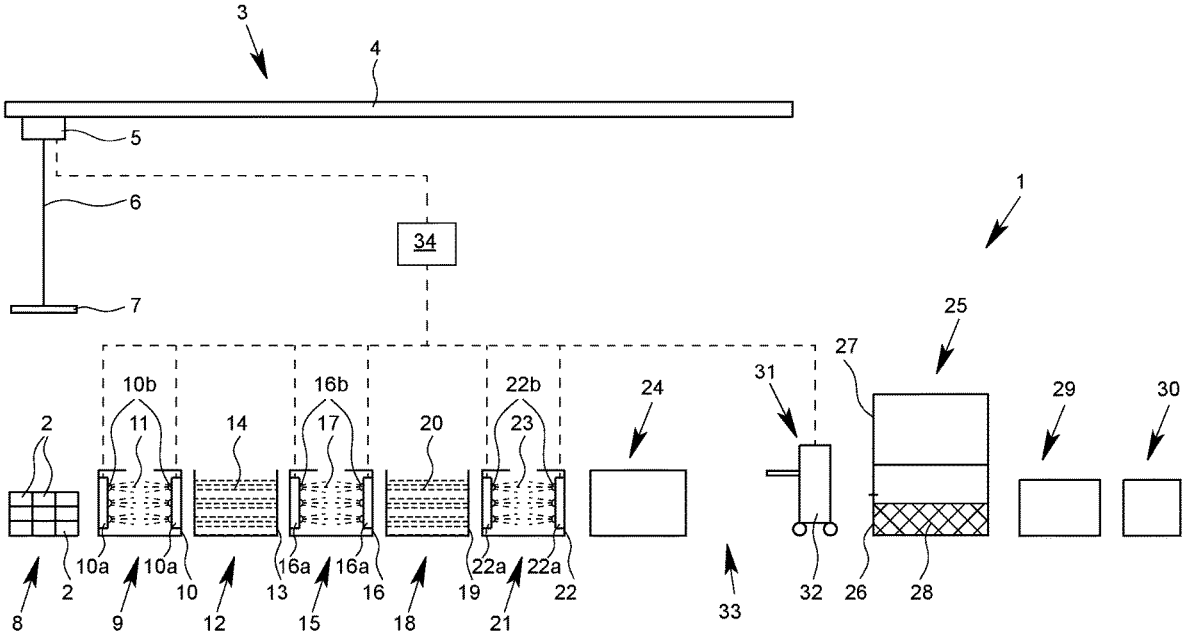
FIG. 2 shows a schematic representation of a system of the invention and of the sequence of the method of the invention in one method step.
Figure 3:
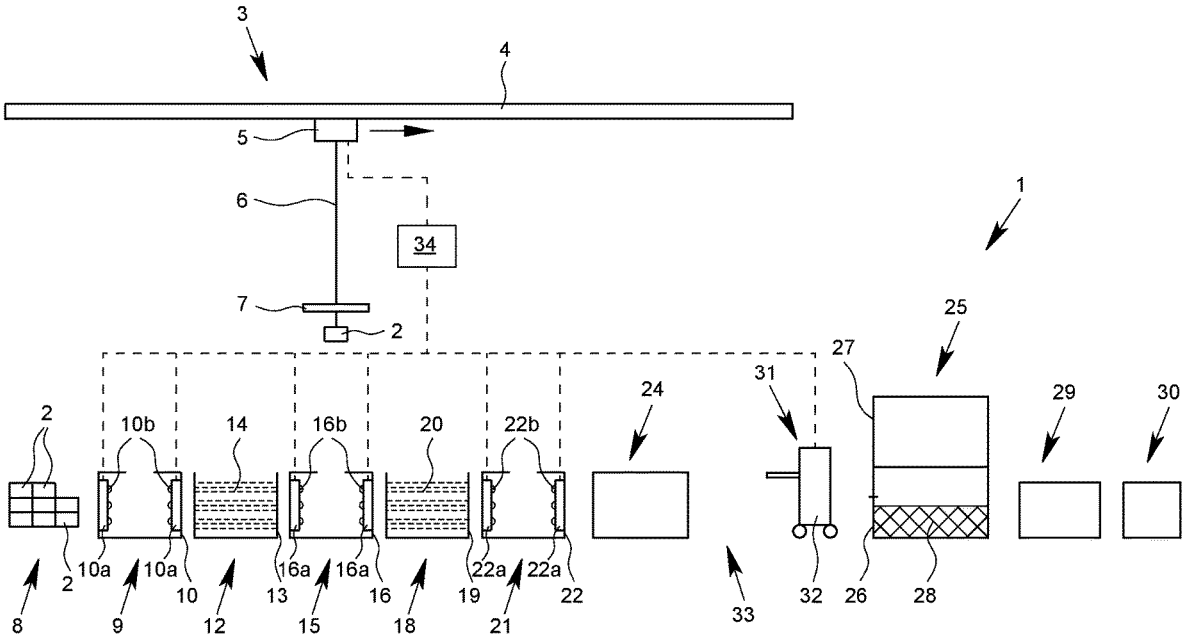
FIG. 3 shows a schematic representation of a system of the invention and of the sequence of the method of the invention in a further method step.
Figure 4:
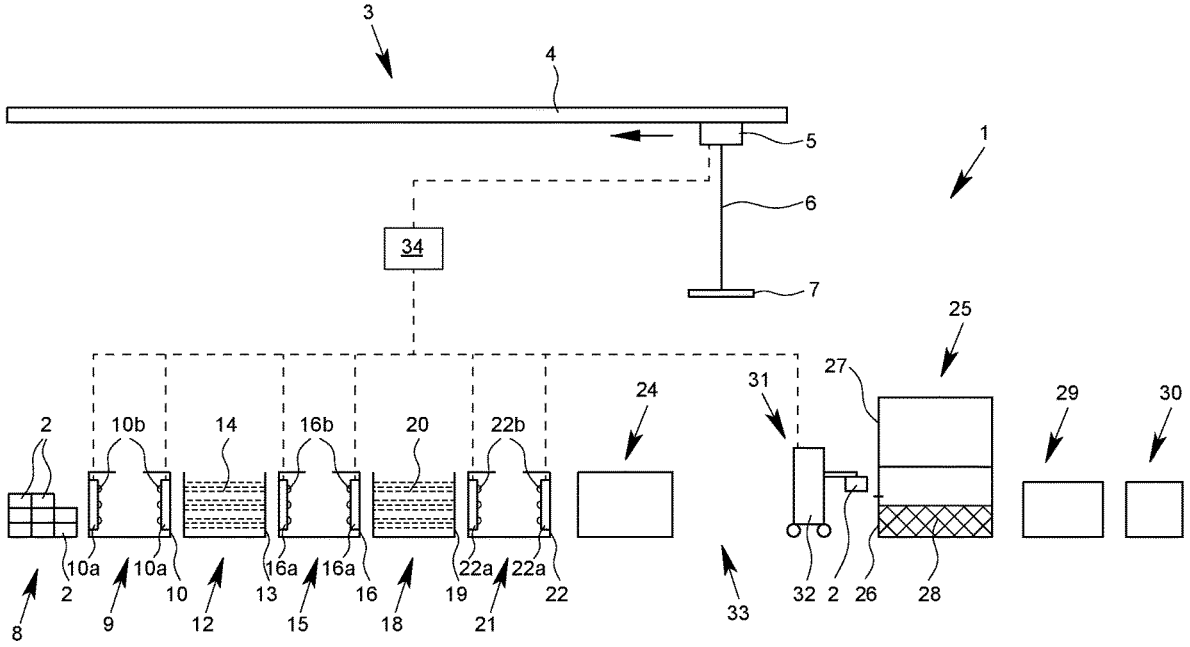
FIG. 4 shows a schematic representation of a system of the invention and of the sequence of the method of the invention in a further method step.

In the drawing:

FIG. 1 shows a schematic sequence of the individual stages of the method of the invention, FIG. 2 shows a schematic representation of a system of the invention and of the sequence of the method of the invention in one method step, FIG. 3 shows a schematic representation of a system of the invention and of the sequence of the method of the invention in a further method step, and FIG. 4 shows a schematic representation of a system of the invention and of the sequence of the method of the invention in a further method step.

In FIG. 1 there is a schematic representation of a sequence of the method of the invention in a system 1 of the invention. In this connection it should be pointed out that the sequence scheme shown is one method possible according to the invention, but individual method steps may also be omitted or provided in a different order from that represented and subsequently described. Further method steps may be provided as well. In any case, not all of the method stages need in principle be provided in one centralized system 1. The decentralized realization of individual method stages is also possible. In particular, a circuit regime for the entire method is possible.

In the sequence scheme represented in FIG. 1, stage A identifies the supplying and the deposition of components 2 for galvanization at a connection point. In the present example, the components 2 have already been mechanically surface-treated, more particularly sandblasted. This is a possibility but not a necessity.

In stage B, the components 2 in the separated (isolated) and singled out state are joined with an goods carrier (article carrier) 7 of a conveying device (means) 3. In the exemplary embodiment illustrated, only one individual component 2 is attached to the goods carrier 7. It is also possible for the goods carrier 7 to comprise a basket, a rack or the like into which the component 2 is placed. Not shown is the further possibility in principle of attaching a plurality of components 2 as a small group on the goods carrier 7. But the components 2 are then spaced sufficiently apart as to ultimately produce a separated (isolated) and singled out state.

In stage C, the component 2 is degreased. This is done using alkaline or acidic degreasing agents 11, in order to eliminate residues of greases and oils on the component 2.

In stage D, the degreased component 2 is rinsed, in particular with water. This washes off the residues of degreasing agent 11 from the component 2.

In the method text E, the surface of the component 2 undergoes pickling, i.e., wet-chemical surface treatment. Pickling takes place customarily with dilute hydrochloric acid.

Stage E is followed by stage F, which is again a rinsing stage, in particular with water, in order to prevent the pickling agent being carried into the downstream method stages.

Then the correspondingly cleaned and pickled component 2 for galvanizing is fluxed, i.e., subjected to a flux treatment. The flux treatment in stage H takes place presently with an aqueous flux solution. Then the goods carrier 7 with the component 2 is passed on for drying in stage I in order to generate a solid flux film on the surface of the component 2 and to remove adhering water.

In method step J, the component 2 is taken from the goods carrier 7. At this point the component can be stored temporarily.

The component 2 is hot-dip galvanized in the stage K. For this purpose, the component 2 is immersed into a galvanizing bath 28 and, after a specified residence time, emersed again.

The galvanizing in method step K is followed by drip-drying of the still liquid zinc in stage L. This drip drying is accomplished, for example, by moving the component 2, galvanized in the separated (isolated) and singled out condition, along one or more strippers of a stripping device (means), and/or by specified pivoting and rotating movements of the component 2, leading either to the dripping off or else to the uniform spreading of the zinc on the component surface.

The galvanized component is subsequently quenched in step M.

The quenching in method step M is followed by an after-treatment in stage N, this after-treatment possibly, for example, being a passivation, sealing, or organic or inorganic coating of the galvanized component 2. The after-treatment, however, also includes any afterwork possibly to be performed on the component 2.

In FIGS. 2 to 4, an exemplary embodiment of a system 1 of the invention is represented schematically.

In FIGS. 2 to 4, in a schematic representation, one embodiment is depicted of a system 1 of the invention for the hot-dip galvanizing of components 2. The system 1 is intended for hot-dip galvanizing a multiplicity of identical components 2 in discontinuous operation, referred to as piece galvanizing. In particular, the system 1 is designed and suitable for the hot-dip galvanizing of components 2 in large-scale (high-volume) production. Large-scale (high-volume) galvanizing refers to galvanizing wherein more than 100, more particularly more than 1000, and preferably more than 10 000 identical components 2 are galvanized in succession without interim galvanizing of components 2 of different shape and size.

The system 1 comprises a conveying device (means) 3 for conveying the components 2. The conveying device (means) 3 presently comprises a crane track with a rail guide 4, on which a trolley 5 with a lifting mechanism can be driven. An goods carrier 7 is connected to the trolley 5 via a lifting cable 6. The purpose of the goods carrier 7 is to hold and fasten the components 2 in the separated (isolated) and singled out state. The components 2 are customarily joined to the goods carrier 7 at a connection point 8 in the system, at which the components 2 are arranged for joining to the goods carrier 7.

The connection point 8 is followed by a degreasing device (means) 9. The degreasing device (means) 9 comprises a degreasing chamber 10 having a spraying device (means) 10*a* with a plurality of spraying heads 10*b* for sprayed application of a degreasing agent 11. The degreasing chamber 10 constitutes an at least substantially complete housing for the spraying device (means) 10*a*, so that sprayed degreasing agent 11 remains as far as possible in the degreasing chamber 10 and does not emerge from the chamber during spraying. The degreasing agent 11 may be acidic or basic.

The degreasing device (means) 9 is followed by a rinsing device (means) 12, comprising a rinsing tank 13 with rinsing agent 14 located therein. The rinsing agent 14 presently is water.

After the rinsing device (means) 12, in other words downstream thereof in the process direction, is a surface treatment device (means) configured as a pickling device (means) 15 for the wet-chemical surface treatment of the components 2. The pickling device (means) 15 comprises a pickling chamber 16 with a spraying device (means) 16*a* and a plurality of spraying heads 16*b* for sprayed application of a pickling agent 17. The pickling chamber 16 constitutes a substantially closed housing of the spraying device (means) 16*a* so that sprayed pickling agent 17 as far as possible does not emerge from the pickling chamber 16 during the spraying operation. The pickling agent 17, presently, is diluted hydrochloric acid.

Subsequent to the pickling device (means) 15 there is, again, a rinsing device (means), 18, with rinsing tank 19 and rinsing agent 20 located therein. The rinsing agent 20 is again water.

Downstream of the rinsing device (means) 18 in the process direction is a flux application device (means) 21 comprising a flux chamber 22 with a spraying device (means) 22*a* having a plurality of spraying heads 22*b* for sprayed application of a flux 23. The flux chamber 22 as well constitutes a substantially closed housing of the spraying device (means) 22*a*, and so the spraying medium is not unable to emerge from the flux chamber 22 during the spraying procedure. In a preferred embodiment, the flux comprises zinc chloride ($ZnCl_2$) in an amount of 58 to 80 wt % and also ammonium chloride ($NH_4Cl$) in the amount of 7 to 42 wt %. Furthermore, in a small amount, there may optionally be alkali metal salts and/or alkaline earth metal salts and also, optionally, in a comparatively further reduced amount, a heavy metal chloride. Additionally there may optionally be a wetting agent in small amounts. It is understood that the aforesaid weight figures are based on the flux 23 and make up 100 wt % in the sum total of all constituents of the composition. Moreover, the flux 23 is present in aqueous solution, specifically at a concentration in the range from 500 to 550 g/l.

The flux application device (means) 21 is followed by a drying device (means) 24, for removal of adhering water from the film of flux located on the surface of the component 2.

Furthermore, the system 1 comprises a hot-dip galvanizing device (means) 25, in which the components 2 are hot-dip galvanized in the separated (isolated) and singled out state. The hot-dip galvanizing device (means) 25 comprises a galvanizing tank 26, optionally with a housing 27 provided at the top. In the galvanizing tank 26 there is a galvanizing bath 28 comprising a zinc/aluminum alloy. Specifically, the galvanizing bath comprises 60 to 98 wt % of zinc and 2 to 40 wt % of aluminum. Furthermore, optionally, small amounts of silicon and, optionally in further-reduced proportions, a small amount of alkali metals and/or alkaline earth metals and also heavy metals are provided. It is understood here that the aforesaid weight figures are based on the galvanizing bath 28 and in total make up 100 wt % of all constituents of the composition.

Located after the hot-dip galvanizing device (means) 25 in the process direction is a cooling device (means) 29 which is provided for quenching the components 2 after the hot-dip galvanizing. Finally, after the cooling device (means) 29, an after-treating device (means) 30 is provided, in which the hot-dip galvanized components 2 can be after-treated and/or afterworked.

Located between the drying device (means) 24 and the hot-dip galvanizing device (means) 25 is a separating device (means) 31, which is provided for the automated supplying, immersion, and emersion of a component 2, separated (isolated) and singled out from the goods carrier 7, into and from the galvanizing bath 28 of the hot-dip galvanizing device (means) 25. In the exemplary embodiment shown, the separating device (means) 31 comprises a separating means 32 which is provided for the handling of the component 2, specifically for removing the component 2 from the goods carrier 7, and also for the supplying, immersing, and emersing of the separated (isolated) and singled out component 2 into and from the galvanizing bath 28.

For the separation, there is a transfer point 33 located between the separating means 32 and the drying device (means) 24, and at this point 33 the component 2 either is put down or else, in particular in the hanging condition, can be taken from the goods carrier 7. For this purpose, the separating means 32 is preferably configured such that it can be moved in the direction of and away from the transfer point 33 and/or can be moved in the direction of and away from the galvanizing device (means) 25.

Moreover, the separating means 32 is configured such that it moves a component 2, immersed separately into the galvanizing bath 28, from the immersion region to an adjacent emersion region and subsequently emerses it in the emersion region. The immersion region and the emersion region here are spaced apart from one another, i.e., do not correspond to one another. In particular, the two regions also do not overlap. The movement from the immersion region to the emersion region here takes place only after a specified period of time has expired, namely after the end of the reaction time of the flux 23 with the surface of the respective components 2 for galvanizing.

Furthermore, the separating device (means) 31 and/or the separating means 32 is/are assigned a control device (means), whereby the separating means 32 is moved such that all of the components 2 separated (isolated) and singled out from the goods carrier 7 are guided through the galvanizing bath 28 with identical movement in identical arrangement, and with identical time.

The control device (means) 34 is in any case coupled not only to the separating means 32 of the separating device (means) 31, but also to the spraying facilities 10*a*, 16*a* and 22*a* and also, moreover, to the trolley 5. By way of the control device (means) 34, therefore, it is possible to control the transport speed of the trolley 5 and hence of the goods carrier 7 from one stage of the method to the next, and also to control the residence time in the respective stage of the method. Furthermore, spray application in the respective method stages can also be controlled by way of the control device (means) 34.

Not depicted is the presence, above the galvanizing bath 28 and still within the housing 27, of a stripper of a stripping device (means) (not shown), this stripper being intended for the stripping of liquid zinc. Moreover, the separating means 32 may also be controlled, via the assigned control device (means), in such a way that a component 2 which has already been galvanized is moved, still within the housing 27, for example, by corresponding rotational movements, in such a way that excess zinc drips off and/or, alternatively, is spread uniformly over the component surface.

FIGS. 2 to 4 then represent different conditions during operation of the system 1. FIG. 2 shows a condition wherein a multiplicity of components 2 for galvanizing are deposited at the connection point 8. Above the group of components 2 there is the goods carrier 7. After the goods carrier 7 has been lowered, a component 2 is attached on the goods carrier 7.

Represented schematically in FIG. 2 is the spraying of the respective spraying composition by each of the spraying facilities 10*a*, 16*a* and 22*a*. In actual fact, however, spraying takes place only if the component 2 located on the goods carrier 7 is actually present in the spraying chamber in question. Ultimately this is controlled by way of the control device (means) 34.

In FIG. 3, the component 2 is located above the pickling device (means) 15. Stages C and D, namely the degreasing and rinsing, have already been performed.

In FIG. 4, the component 2 has been deposited at the transfer point 33. The trolley 5 is on the way back to the connection point 8, to pick up a new component 2. The component deposited at the transfer point 33 has already been picked up, via the separating means 32, and therefore this component 2 is about to be fed into the hot-dip galvanizing device (means) 25.

The embodiment depicted is only one possible configuration of the system 1 of the invention. In principle it is possible for the conveying device (means) 3 to comprise a circulating rail guide 4. The rail guide 4 in this case represents a closed track. With this embodiment it is possible for two or more goods carriers 7 to be provided. The rail guide 4 then forms a closed circuit. It is possible, moreover, for the conveying device (means) 3 to be configured not as a crane track but rather as a floor conveyor. One or more goods carriers 7 then run on the floor, optionally along a rail guide, and enter the individual stages of the method as they do so. In this case as well there may be two or more goods carriers 7 provided.

It is also possible—in deviation from the exemplary embodiment shown—to transport a plurality of separated (isolated) and singled out components 2 in the form of a small group. In that case it is critical that the individual components 2 on the goods carrier 7 have a sufficient spacing from one another, so that all-round accessibility of the components 2 attached on the respective goods carrier 7 is possible.

Where spraying of the component 2 takes place, provision is made for a recycling device (means) (not shown). In particular, the spraying composition dripping off from the component 2 in the respective chamber and not remaining on the component 2 is collected on the floor of the respective chamber and recycled. Recycling is preferably preceded by processing, more particularly cleaning, of the respective spraying composition.

Not depicted, moreover, is the possibility of the rinsing facilities 12 and 18 also comprising a spraying device (means) of the type described above, provided in a corresponding spraying chamber. Consequently, rinsing need not necessarily take place by means of immersive rinsing.

Also not shown is that the individual spraying facilities 10*a*, 16*a* and 22*a* have adjustable spraying heads 10*b*, 16*b* and 22*b*. In this case each spraying head 10*b*, 16*b*, 22*b* may be independently adjustable, or else a group of spraying heads 10*b*, 16*b*, 22*b* may be adjustable in unison. In particular, the respective spraying device (means) may be designed such that the respective spraying composition can be sprayed on with different concentrations. This may be accomplished, for example, by supplying a highly concentrated spraying composition via a spraying line, while supplying a diluent—water, for example—via a different spraying line.

Instead of the separating device (means) 31 depicted it is also possible, moreover, for the components 2 to be guided in the separated (isolated) and singled out state on the goods carrier 7 through the hot-dip galvanizing device (means) 25. Hence transport to the subsequent steps of the method as well, those that follow the hot-dip galvanizing, may take place by way of the conveying device (means) 3.

List of reference symbols:

| | |
|---|---|
| 1 | System |
| 2 | Component |
| 3 | Conveying device (means/facility) |
| 4 | Rail guide |
| 5 | Trolley |
| 6 | Lifting cable |
| 7 | Goods carrier (Article carrier) |
| 8 | Connection point |
| 9 | Degreasing device (means/facility) |
| 10 | Degreasing chamber |
| 10a | Rinsing device (means/facility) |
| 10b | Spraying head |
| 11 | Degreasing agent |
| 12 | Rinsing device (means/facility) |
| 13 | Rinsing tank |
| 14 | Rinsing agent |
| 15 | Pickling device (means/facility) |
| 16 | Pickling chamber |
| 16a | Rinsing device (means/facility) |
| 16b | Rinsing head |
| 17 | Pickling agent |
| 18 | Rinsing device (means/facility) |
| 19 | Rinsing tank |
| 20 | Rinsing agent |
| 21 | Flux application device (means/facility) |
| 22 | Flux chamber |
| 22a | Spraying device (means/facility) |
| 22b | Spraying head |
| 23 | Flux |
| 24 | Drying device (means/facility) |
| 25 | Hot-dip galvanizing device (means/facility) |
| 26 | Galvanizing tank |
| 27 | Housing |
| 28 | Galvanizing bath |
| 29 | Cooling device (means/facility) |
| 30 | After-treating device (means/facility) |
| 31 | Separating device (means/facility) |
| 32 | Separating means |

-continued

| List of reference symbols: | |
|---|---|
| 33 | Transfer point |
| 34 | Control device (means/facility) |

The invention claimed is:

1. A system for hot-dip galvanization of components, which system is configured for the hot-dip galvanization of a multiplicity of identical or essentially identical components, wherein the system comprises:

a conveying device with at least one goods carrier for conveying the components, wherein the at least one goods carrier is configured for receiving and for transporting at least one separated and singled out component, a flux application device for applying a flux to the surface of the components, wherein the flux application device comprises a spraying device for the automated spray application of the flux to the surface of a separated and singled out component, wherein the spraying device comprises a plurality of spraying heads, wherein at least one spraying head can be moved in at least one of the X-direction, the Y-direction and the Z-direction relative to the component, and wherein the spraying device comprises a recycling device configured for the recycling and cleaning of the flux dripping off from the at least one separated and singled out component;

a hot-dip galvanizing device for hot-dip galvanizing the components, with the hot-dip galvanizing device comprising a galvanizing bath containing a zinc/aluminum alloy in liquid melt form; and a separating device for an automated supplying, immersing and emersing of a single component, separated and singled from the at least one goods carrier, into and from the galvanizing bath of the hot dip galvanizing device;

wherein the system further comprises a control device coupled to the spraying device for the automatic spray application of the flux, which control device is configured for the automated control of the spray application as a function of at least one of (i) the form, (ii) the type, (iii) the material and (iv) the surface nature of the component, wherein the control device is configured such that there is effected a spray application which is homogeneous and adapted individually to the component, and wherein the control device is configured for the automated control of at least one of (i') the thickness of the spray application on the component, (ii') the concentration of the flux, (iii') the spraying duration of the spray application per component, (iv') the spraying duration of the spray application of different regions of a component, (v') the simultaneous spray application of different fluxes and (vi') the simultaneous spray application of different flux components.

2. The system as claimed in claim 1, wherein the at least one goods carrier is configured and provided for receiving and for transporting only a single separated and singled out component.

3. The system as claimed in claim 1, wherein the at least one goods carrier is configured and provided for receiving and for transporting a small group of components separated and singled out from one another wherein the small group of components comprises a maximum of ten components.

4. The system as claimed in claim 1, wherein the spraying device is configured for the simultaneous sprayed application of at least one of different fluxes and different flux components.

5. The system as claimed in claim 1, wherein a drying device is additionally provided subsequent to or downstream of the flux application device, which drying device is configured for drying the component after flux application;

wherein a surface treating device positioned ahead or upstream of the flux application device, is further provided, which surface treating is configured for the chemical surface treatment of the components by means of a surface treating agent, and wherein a degreasing device positioned ahead or upstream of the surface treating device is further provided, which degreasing device is configured for degreasing the components by means of a degreasing agent.

6. The system as claimed in claim 1, wherein the separating device and the hot-dip galvanizing device are configured such that the component attached on the separating device is guided in the separated and singled out state through the galvanizing bath.

7. The system as claimed in claim 1, wherein the separating device is configured such that all components are guided in an identical way through the galvanizing bath.

8. The system as claimed in claim 1, wherein a stripping device is provided subsequent to or downstream of the emersion region of the galvanizing bath, which stripping device is configured for the stripping of liquid zinc after emersion from the galvanizing bath.

9. The system as claimed in claim 1, wherein the control device is coupled to the conveying device for changing the transport speed of the at least one goods carrier.

10. The system as claimed in claim 1, wherein the conveying device comprises a circulating and closed transport section having a plurality of goods carriers.

* * * * *